US006591748B2

(12) United States Patent
Kerpe et al.

(10) Patent No.: US 6,591,748 B2
(45) Date of Patent: Jul. 15, 2003

(54) DEVICE FOR BRAKING SHEETS

(75) Inventors: Sven Kerpe, Eggenstein-Leopoldshafen (DE); Michael Krüger, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 56 days.

(21) Appl. No.: 09/821,852

(22) Filed: Mar. 30, 2001

(65) Prior Publication Data

US 2001/0025578 A1 Oct. 4, 2001

(30) Foreign Application Priority Data

Mar. 30, 2000 (DE) ..... 100 15 898

(51) Int. Cl.[7] ..... B65H 5/22

(52) U.S. Cl. ..... 101/232; 271/182; 271/195; 271/197

(58) Field of Search ..... 318/41, 56, 57, 318/61; 271/195, 182, 199, 197, 3.15, 3.17; 101/232, 233, 242

(56) References Cited

U.S. PATENT DOCUMENTS

| | | | | |
|---|---|---|---|---|
| 3,735,976 A | | 5/1973 | Watson | |
| 4,282,439 A | * | 8/1981 | Matsuura | 378/173 |
| 4,693,462 A | * | 9/1987 | Pollich | 271/183 |
| 4,828,246 A | * | 5/1989 | Wegel et al. | 271/182 |
| 4,908,667 A | * | 3/1990 | Ikeura et al. | 399/166 |
| 5,278,477 A | * | 1/1994 | Hartmann et al. | 318/112 |
| 5,527,027 A | * | 6/1996 | Flade et al. | 271/228 |
| 5,757,147 A | * | 5/1998 | Blumor et al. | 271/256 |
| 6,056,287 A | | 5/2000 | Hirth et al. | |
| 6,105,954 A | * | 8/2000 | Magee et al. | 271/10.03 |
| 6,382,624 B1 | * | 5/2002 | Kelm et al. | 271/264 |
| 6,417,643 B1 | * | 7/2002 | Shiba et al. | 318/34 |
| 6,419,220 B1 | * | 7/2002 | Pollich | 271/3.17 |

FOREIGN PATENT DOCUMENTS

| | | |
|---|---|---|
| DE | 197 58 446 | 10/1998 |
| DE | 199 57 574 | 9/2000 |
| GB | 2 307 470 A | 5/1997 |

* cited by examiner

*Primary Examiner*—Andrew H. Hirshfeld
*Assistant Examiner*—Dave A. Ghatt
(74) *Attorney, Agent, or Firm*—Laurence A. Greenberg; Werner H. Stemer; Ralph E. Locher

(57) ABSTRACT

A sheet-braking device for a sheet-processing machine includes a plurality of brake modules with a revolving suction belt formed with at least one suction opening. The brake modules have assigned thereto individual drives with controls for stipulating a reference speed relative to a speed of the machine.

12 Claims, 3 Drawing Sheets

DEVICE FOR BRAKING SHEETS

BACKGROUND OF THE INVENTION

FIELD OF THE INVENTION

The invention relates to a device for braking sheets, in particular, for a delivery of a sheet-fed printing machine, the sheet-braking device having a plurality of brake modules with a rotating suction belt having at least one suction opening.

In the processing of paper sheets, in particular, on sheet-fed printing machines, it is necessary for the sheets to be braked before they are deposited onto a pile or stack. This purpose is served by braking devices of the type mentioned hereinabove, the number of brake modules provided for the braking device depending upon the size and nature of the sheet to be braked.

It has become known, for example, from the published German Patent Document DE 44 35 988 A1, to equip the individual brake module with a common drive. A common drive of this type, which is usually constructed as a shaft, makes it extremely complicated to install or remove the individual brake modules. It is consequently difficult for them to be exchanged, for example, in the event of wear. Disengaging them is troublesome, for example, when a sensitive region of the image has to be protected and is not to be subjected to the action of a brake module. Due to the transmission elements, the construction calls a great amount of space, and is also extremely sensitive to dirt. For example, powdery dust settles on the transmission elements at the delivery of sheet-fed printing machines. This is especially critical when the transmission elements contain couplings or gears. Wear of such couplings due to relative movements also occurs as a result of errors in the alignment of the transmission. Moreover, when a drive shaft is used, the system is overdefined in static terms which leads to sluggishness of the individual suction-roller modules.

SUMMARY OF THE INVENTION

It is accordingly an object of the invention to provide a device for braking sheets of the aforedescribed general type which is insensitive to dirt and easy to maintain, it being possible for the individual brake modules to be installed and removed in a simple way and also be disengaged selectively in a relatively easy manner.

With the foregoing and other objects in view, there is provided, in accordance with the invention, a sheet-braking device for a sheet-processing machine, comprising a plurality of brake modules with a revolving suction belt formed with at least one suction opening, the brake modules having assigned thereto individual drives with controls for stipulating a reference speed relative to a speed of the machine.

In accordance with another feature of the invention, the individual drives are synchronously running drives.

In accordance with a further feature of the invention, the synchronism of the individual synchronously running drives is achievable by a closed-loop control, each of the brake modules having assigned thereto an actuator, a transmitter, an actual-value detection and regulating device.

In accordance with an added feature of the invention, the individual drives are stepping motors, and the controls, respectively, serve for initiating the steps thereof.

In accordance with an additional feature of the invention, the stepping motors serve for driving the suction belts directly, without gears.

In accordance with yet another feature of the invention, the individual drives are external rotor motors, and the suction belts run over the motors.

In accordance with yet a further feature of the invention, at least one sensor serves for detecting the actual position of a sheet and, in the event of a deviation from the desired position, a control serves for changing the speed of the brake modules so that the position of the sheet is corrected.

In accordance with yet an added feature of the invention, the control serves to impart a specific behavior to the respective sheet by virtue of the different rotational speed ratio of the brake modules.

In accordance with yet an additional feature of the invention, each of the suction belts has a monitoring sensor assigned thereto for monitoring a run of the suction belt.

In accordance with still another feature of the invention, the brake modules are arranged adjustably and exchangeably.

In accordance with still a further feature of the invention, the brake modules are fastened displaceably and removably on a guide rail.

In accordance with a concomitant feature of the invention, the sheet-processing machine is a sheet-fed printing machine, and the sheet-braking device is for a delivery of the printing machine.

The invention avoids any need for transmission elements. The separate drives can be constructed with a smaller space requirement than the transmission elements of the prior art. There is no soiling of transmission elements, such as, for example, the drive shaft, coupling elements or gears. By employing individual drives, the number of openly movable parts of the individual brake modules can be reduced to a minimum, with the result that soiling decreases and the long lasting service life of the brake modules is appreciably increased. This is a major advantage when they are installed in deliveries of sheet-fed printing machines, because powder devices are arranged in these regions, and the pulverulent dust settles on such transmission elements.

The separate drives have appreciably lower wear, because they no longer have errors of alignment, as is the case with the transmission elements of a common drive. By using the separate drives, the individual brake modules are also no longer sluggish, as is the case in a system with a common drive. The individual brake modules of the device according to the invention, in the event of wear or when they are to be exchanged for specific applications, can easily be removed or can be displaced outside the printing area and parked there.

If desired, it is also possible to vary the speeds of the individual brake modules, in order thereby to correct the position of the sheet or to impart a specific behavior to a sheet.

The individual drives are expediently synchronously running drives, the synchronicity of the individual drives being achievable by controls without feedback, for example, via the frequency. It is also possible for the synchronicity of the individual drives to be achieved by closed-loop control, in which case each brake module has assigned thereto an actuator, a transmitter, and an actual-value detection and regulating device.

In a particularly expedient embodiment, the individual drives are stepping motors, and the control initiates the steps. This greatly simplifies the activating electronics, and the transmitter and transmitter line and also a closed-loop control can be dispensed with. By having a stepping motor assigned to each brake module, it is possible for the stepping motors to drive the suction belts directly, i.e., without gears. The required torques are achieved in this regard.

In an advantageous development, the individual drives are external rotor motors, with the suction belts running over the motors. There is therefore no need for space to arrange the individual motors therein, and it is no longer necessary to transmit force between the motor and the drive roller.

The device according to the invention also affords the possibility of operating the brake modules at different speeds. Thus, provision may be made for at least one sensor to detect the actual position of the sheet and, in the event of a deviation from the desired position, for a control to change the speed of the brake modules so that the position of the sheet is corrected. Often only slight deviations from synchronicity are necessary for this, so that, when stepping motors are used, it is often expedient to have a microstepping mode for a correction. In this way, for example, sheets arriving obliquely can be braked more on one side and less on the other side, in order to achieve an exact position on the delivery pile.

Due to the sheet-braking device according to the invention, it is also possible that a specific behavior can be imparted to the sheet through the intermediary of a control, by virtue of a different rotational speed ratio of the brake modules. This can be adopted in the case of various printing materials, such as, for example, cardboard, because the deposition behavior on the delivery pile can often be favorably influenced by braking differently, as seen over the width.

Expediently, each suction belt has assigned thereto a monitoring sensor for monitoring the run of the suction belt. The monitoring sensor may be constructed so that it receives pulses as a result of the running of the belt. If pulses are no longer emitted, a tear in the suction belt or some other fault may be the cause, and it is advantageous if this is signaled to the operator.

Expediently, the brake modules are arranged adjustably and exchangeably, for example, in that they are fastened displaceably and removably on a guide rail. It is thereby possible, in the case of sensitive regions of a print image, to arrange the brake modules so that they do not come into contact with such regions of an image. It is also possible to set the brake modules to different formats or to replace them by differently constructed brake modules, depending upon the requirements which are usually prescribed by the print carrier.

Other features which are considered as characteristic for the invention are set forth in the appended claims.

Although the invention is illustrated and described herein as embodied in a device for braking sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
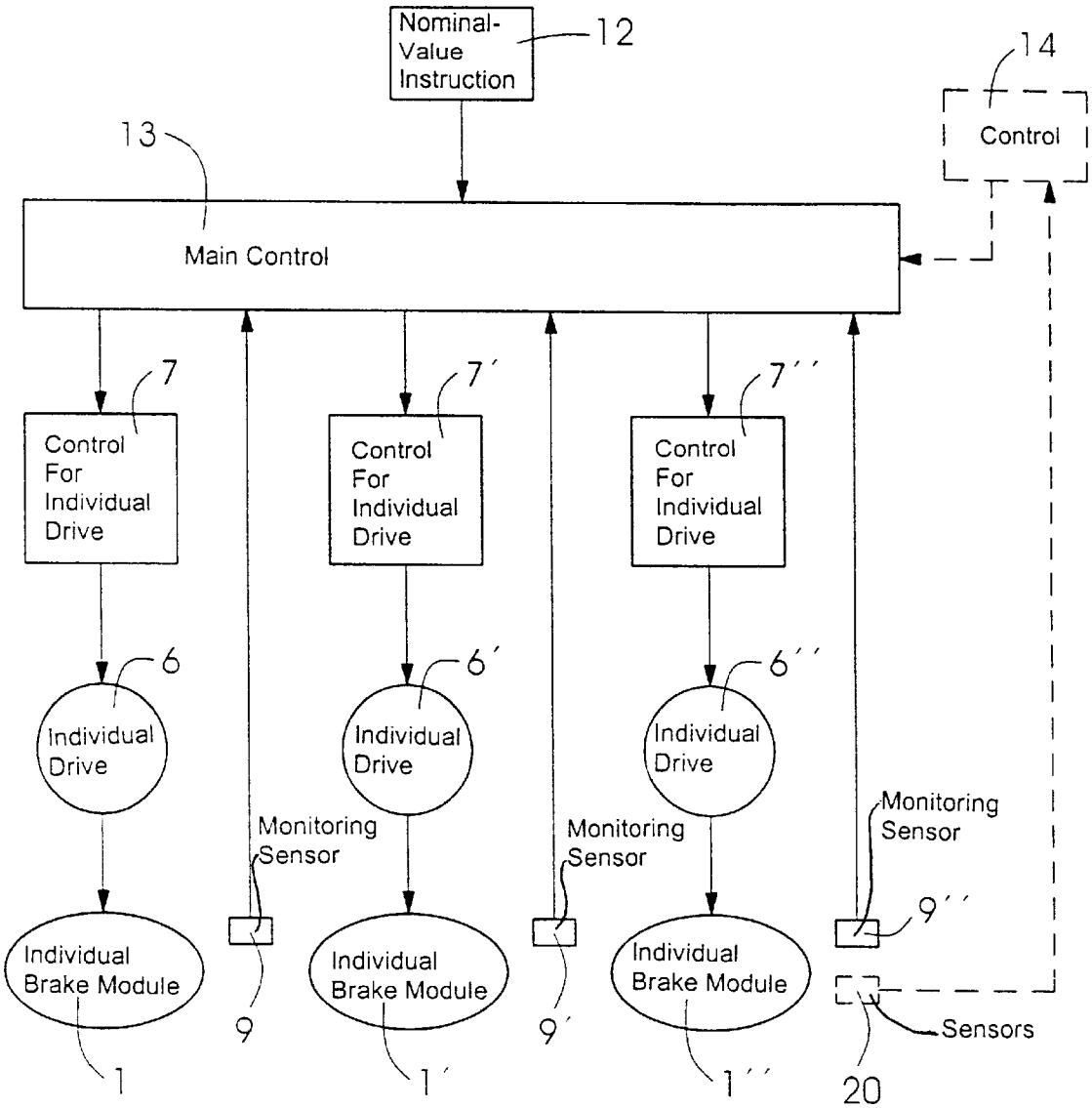
FIG. 1 is a basic block diagram showing the functioning of the sheet-braking device according to the invention.

Referring now to the drawings and, first, particularly to FIG. 1 thereof, shown therein are elements of the sheet-braking device according to the invention in a basic block diagram.

Individual brake modules 1, 1', 1" of the braking device are provided, respectively, with an individual drive 6, 6', 6". Each individual drive 6, 6', 6" has a respective individual control 7, 7', 7" assigned thereto. This may be a simple control for ensuring a rotary angle according to an instruction, or may possibly be closed-loop controls with feedback. For the simple control, it is sufficient to transmit the machine speed by a desired or nominal-value instruction 12 which goes to a main control 13 in order to form a reference speed for the brake modules. The reference speed is transmitted from there to the respective individual controls 7, 7', 7" for the individual drives 6, 6', 6". Such a simple individual control 7, 7', 7" without feedback is usually sufficient because there is usually a pronounced slip between the suction belts 5 and the sheets 2. By using suction belts 5, which are constructed in such a manner that they allow the pronounced slip, it is also possible to employ unregulated motors, for example, unregulated stepping motors.

In one development, another control 14 is provided, which is connected to sensors 20 detecting the position of the sheets 2. According to this position, the other control 14 instructs the main control 13 with deviations from the reference value which cause differentiated reference speeds to be applied to the individual controls 7, 7', 7", in order thereby to achieve different sheet brakings over the width of the sheets. It is consequently possible to correct the sheet position and, as a result, achieve an exact deposition of the sheet 2 on the delivery pile 16 even when the respective sheet 2 arrives at the sheet braking device in an oblique position. It is also thereby possible to impart a specific behavior to a sheet by different reference speeds and, in the case of many print carriers, this may lead to better depositions on the delivery pile 16.

Figure 2:
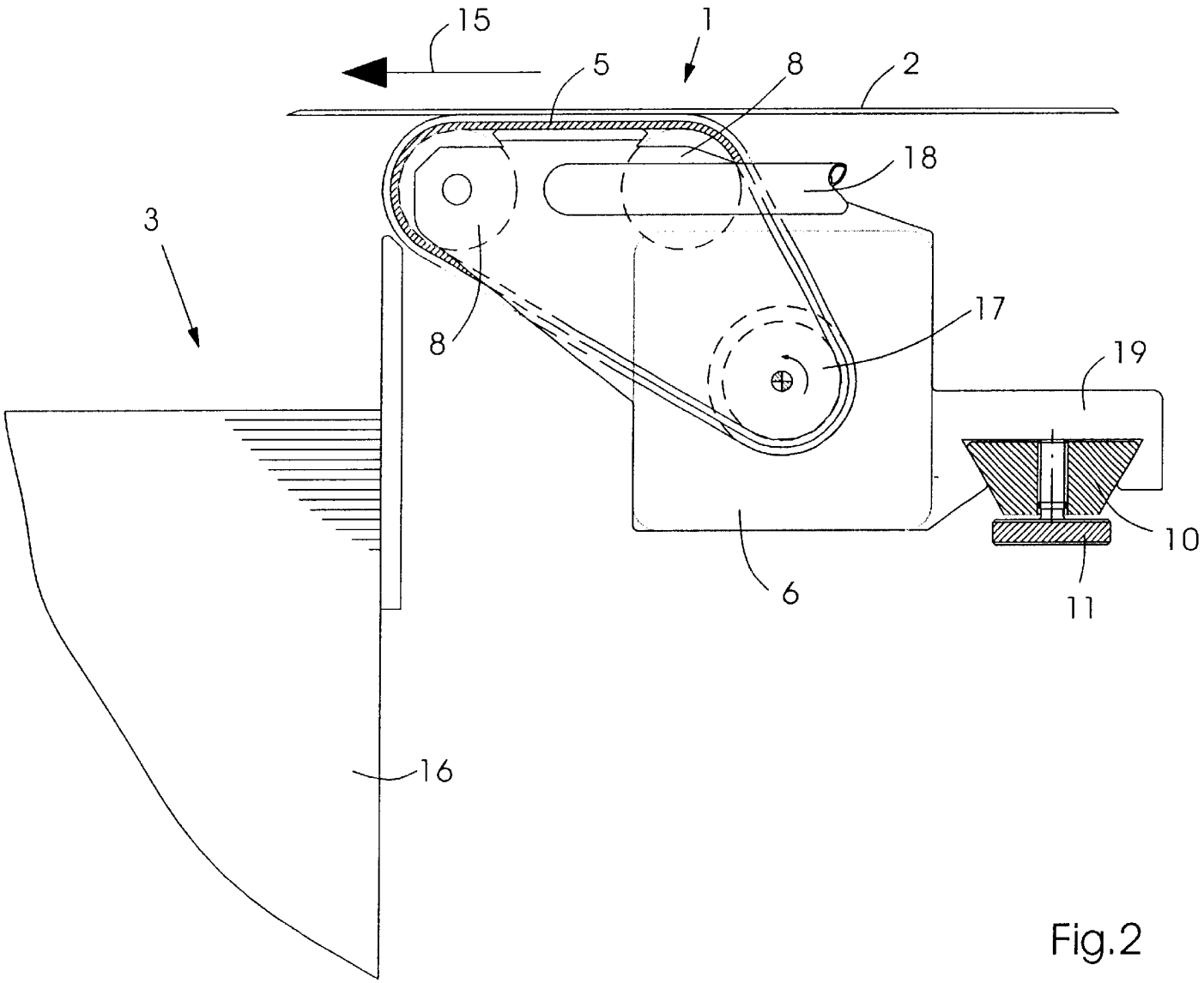
FIG. 2 is a side elevational view, partly in section and partly broken away, of a brake module of the type according to the invention on a delivery pile of a sheet-fed printing machine.

FIG. 2 is a side elevational view of a brake module 1 of the type constructed in accordance with the invention. This brake module 1 is arranged at the delivery 3 of a sheet-fed printing machine. The sheets 2 coming from the printing machine are braked by the sheet-braking device, so that they are deposited exactly on the delivery pile 16. In this case, a plurality of brake modules 1 are arranged transversely to the sheet path 15, in order to apply braking moments which are distributed uniformly over the sheet 2.

At the same time, according to the invention, each brake module 1, 1', 1" has assigned thereto an individual drive 6, 6', 6", respectively. Each individual drive 6 is connected to a drive roller 17 for driving a suction belt 5. The suction belt 5 is also looped about deflecting rollers 8, in order to achieve an alignment parallel to the conveying direction 15 of the sheet 2 on the upper side. The suction belt 5 is formed with suction openings or orifices 4 (note FIG. 3), through which suction air is applied via an air supply 18. When a sheet 2 arrives at the brake module 1, it is picked up by the suction orifices 4 of the suction belt 5 and braked so that it is deposited neatly on the delivery pile 16.

Because each brake module 1, 1', 1" is equipped with an individual drive 6, 6', 6", respectively, there is no need for a transmission element for the drive, and it is thereby possible to clamp the brake modules 1, 1', 1" on a guide rail 10 in a simple manner through the intermediary of a mounting 19, for example, with the aid of a clamping screw 11. When the latter is loosened, the respective brake module 1 can easily be displaced on the guide rail 10. It is thereby possible to select the positions of the brake modules 1, 1', 1" freely, for example, in order to protect sensitive regions of an image or to set the brake modules according to the format width. Also, the brake modules can easily be replaced or exchanged for brake modules which are adapted to another print carrier.

Figure 3:
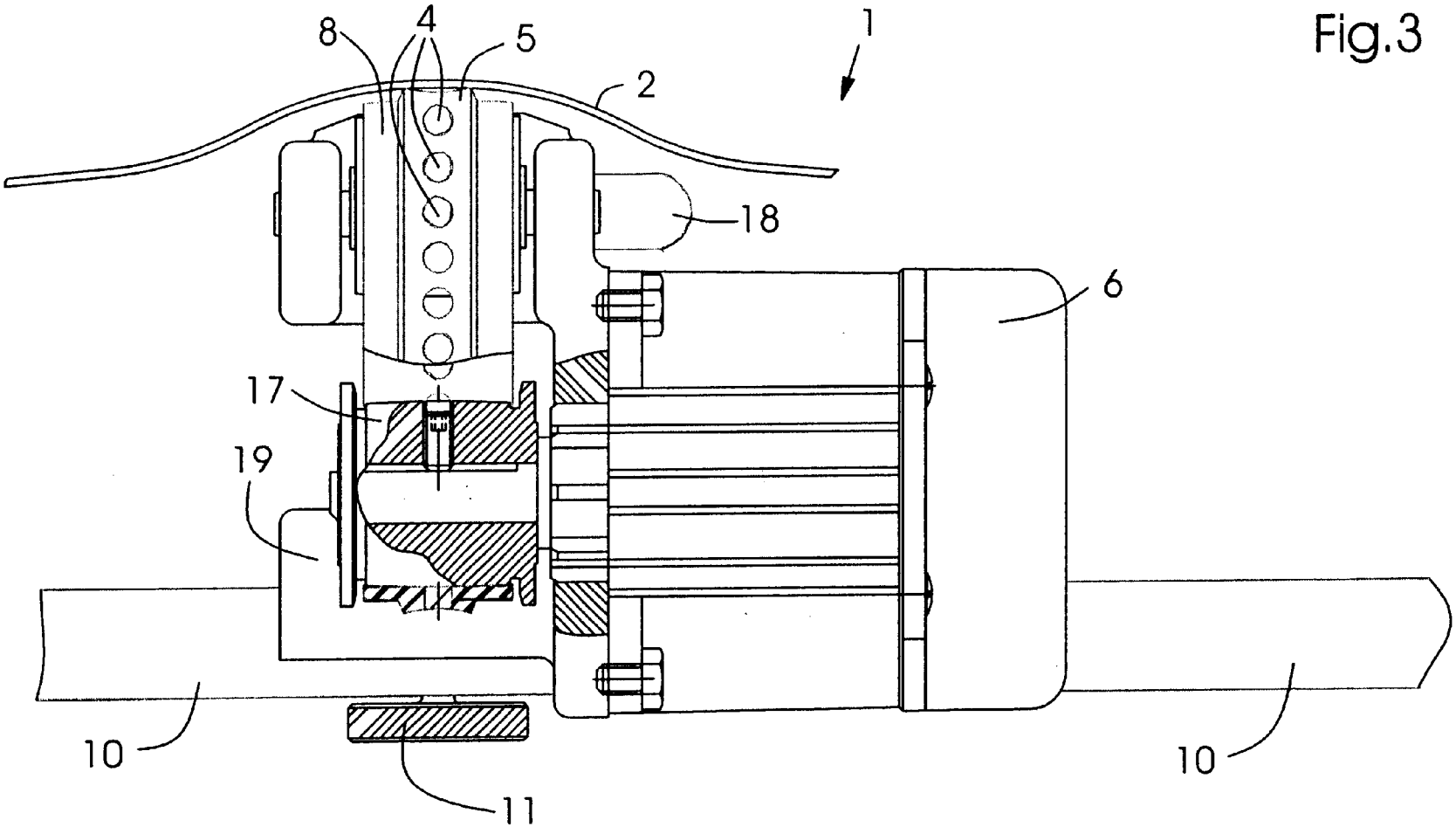
FIG. 3 is an end elevational view, partly in section and partly broken away, of FIG. 2 as viewed from the lefthand side of the figure and opposite to the sheet conveying direction.

FIG. 3 shows a brake module 1 of this type viewed opposite to the sheet conveying direction 15. The suction openings or orifices 4 of the suction belt 5, by which the sheet 2 is picked up, held and braked, can be seen in this illustration. The other components correspond to what was described hereinabove.

The illustration relates merely to one exemplary embodiment, however, other exemplary embodiments are conceivable, reference being made, in particular, to an embodiment wherein the individual drive 6 is constructed as an external rotor motor. In this embodiment, the individual drive 6 projecting to the side is dispensed with, because it is integrated into the drive roller 17. This results in an embodiment which is particularly space-saving and in which it is possible to arrange the brake modules 1, 1', 1", respectively, next to one another even more closely.

We claim:

1. A sheet-braking device for a sheet-processing machine, comprising a plurality of brake modules with a revolving suction belt formed with at least one suction opening, said brake modules having assigned thereto individual drives with controls for stipulating a reference speed relative to a speed of the machine.

2. A sheet-braking device according to claim 1, wherein said individual drives are synchronously running drives.

3. The sheet-braking device according to claim 2, wherein the synchronism of said individual synchronously running drives is achievable by a closed-loop control, each of said brake modules having assigned thereto an actuator, a transmitter, and an actual-value detection and regulating device.

4. The sheet-braking device according to claim 2, wherein said individual drives are stepping motors, and said controls, respectively, serve for initiating the steps thereof.

5. The sheet-braking device according to claim 4, wherein said stepping motors serve for driving said suction belts directly, without gears.

6. The sheet-braking device according to claim 1, wherein said individual drives are external rotor motors, and said suction belts run over said motors.

7. The sheet-braking device according to claim 1, wherein at least one sensor serves for detecting the actual position of a sheet and, in the event of a deviation from the desired position, another control serves for changing the speed of the brake modules so that the position of the sheet is corrected.

8. The sheet-braking device according to claim 7, wherein said other control serves to impart a specific behavior to the respective sheet by virtue of the different rotational speed ratio of said brake modules.

9. The sheet-braking device according to claim 1, wherein each of said suction belts has a monitoring sensor assigned thereto for monitoring a run of said suction belt.

10. The sheet-braking device according to claim 1, wherein said brake modules are arranged adjustably and exchangeably.

11. The sheet-braking device according to claim 10, wherein said brake modules are fastened displaceably and removably on a guide rail.

12. The sheet-braking device according to claim 1, wherein the sheet-processing machine is a sheet-fed printing machine, and the sheet-braking device is for a delivery of the printing machine.

* * * * *